United States Patent [19]

Sherman

[11] 4,124,440

[45] Nov. 7, 1978

[54] CHIP BIN STEAM DISTRIBUTOR WITH A VIBRATING DISCHARGE

[75] Inventor: Michael I. Sherman, Glens Falls, N.Y.

[73] Assignee: Kamyr Inc., Glens Falls, N.Y.

[21] Appl. No.: 799,782

[22] Filed: May 23, 1977

[51] Int. Cl.[2] ..... D21C 7/08; D21C 7/10

[52] U.S. Cl. ..... 162/246; 162/250; 222/146 HS; 222/199

[58] Field of Search ..... 162/246, 250, 245, DIG. 10, 162/52, 46, 17, 19, 242; 222/195, 199, 146 HS

[56] References Cited

U.S. PATENT DOCUMENTS

| | | | |
|---|---|---|---|
| 2,569,085 | 9/1951 | Wood et al. | 222/199 |
| 2,799,579 | 7/1957 | Messing | 162/237 |
| 3,236,422 | 2/1966 | Bailey et al. | 222/195 |
| 3,278,090 | 10/1966 | Wahl | 222/199 |
| 3,380,883 | 4/1968 | Richter et al. | 162/237 |
| 3,435,993 | 4/1969 | Hunkel | 222/195 |
| 3,471,364 | 10/1969 | Starrett | 162/246 |
| 3,471,365 | 10/1969 | Agplund | 162/237 |
| 3,495,710 | 2/1970 | Bely et al. | 222/199 |

FOREIGN PATENT DOCUMENTS

| | | | |
|---|---|---|---|
| 1,435,990 | 3/1965 | France | 222/195 |

OTHER PUBLICATIONS

"Vibra Screw Bin Activator" Brochure by Vibra Screw, Inc. 1971.

*Primary Examiner*—S. Leon Bashore
*Assistant Examiner*—Steve Alvo
*Attorney, Agent, or Firm*—Cushman, Darby & Cushman

[57] ABSTRACT

A chips bin that allows thorough steaming of the chips in the bin without blockage of the chip flow. A chips bin with a vibrating discharge includes an activator cone and a number of support arms extending from the activator cone to the bottom portion of the bin. A number of steam ports are formed in each of the supporting arms and steam is introduced into the supporting arms and underneath the activator cone. The steam ports are formed in sidewalls of the supporting arms, and steam is introduced both underneath the bottom portion of the cone and underneath a top portion of the cone.

10 Claims, 4 Drawing Figures

CHIP BIN STEAM DISTRIBUTOR WITH A VIBRATING DISCHARGE

BACKGROUND AND SUMMARY OF THE INVENTION

The invention relates to a chips bin having a vibrating discharge with means for steaming the chips in the bin so that thorough steaming is accomplished without blockage of the chips flow. Conventionally, in the production of pulp from cellulosic fiber material, chips are fed into a chips bin, are metered from the bin into a horizontal pre-steaming vessel, and subsequently are passed to the top a continuous digestor, such as shown in U.S. Pat. No. 3,429,773. Some installations replace the horizontal pre-steaming vessel with a vertical pre-steaming vessel, such as shown in Kamyr Incorporated Bulletin No. 200C, 1968, page 23. It has been proposed to eliminate the pre-steaming vessels in such installations — or at least minimize the size of such pre-steaming vessels — by directly steaming the chips in the bin. However, in the past many practical difficulties have been associated with attempts to pre-steam chips in the chips bin. The volume of steam necessary to properly steam the chips in the chips bin normally results in blockage of the chips flow through the chips bin, and the difficulties in steam introduction result in a lack of uniformity in the chips treatment.

According to the apparatus of the present invention, it is possible to effect steaming of chips in a conventional vibrating discharge chips bin (called a "Vibra Bin" discharge) without blockage of chips flow, and while achieving a uniform steaming of the chips. According to the invention, even under adverse climatic conditions, where the chips are introduced into the bin in frozen condition and with ice, it is still possible to add sufficient steam to heat the entire frozen mass to above 200° F. in the chips bin itself — again without blockage of the chips flow and with completely uniform steaming of the chips.

Conventional chips bin with vibrating discharges include a generally funnel-shaped stationary top portion, and oscillatable bottom portion including a flexible material chips outlet, an activator cone connected to the bottom portion, and a gyrator for oscillating the bottom portion — including the activator cone — up and down with respect to the stationary top portion along a line concentric with the stationary top portion and activator cone. The activator cone is connected to the bottom portion by a plurality of arms extending radially outward from the activator. In previous, unsuccessful attempts at steaming in the chips bin, the steam has been added either underneath the activator cone, or on the side of the bin. Such attempts did not result in uniform steaming, and because of the large volume of steam that it was necessary to introduce in order to effect steaming, blockage of the chips flow often resulted.

According to the improvement of the present invention, the means for adding steam to the interior volume of the chips bin comprises a plurality of steam ports formed in each of the supporting arms of the activator cone. Each of the supporting arms has a pair of side faces disposed in generally vertical planes, and a plurality of steam ports are formed in each side face of each supporting arm. Preferably, four supporting arms are provided equally spaced around the circumference of the activator cone. Also, according to the present invention, steam is introduced underneath the activator cone, and underneath a top portion of the activator cone. In this way, it is possible to add sufficient steam to heat even frozen chips to above 200°F. in the chips bin itself without affecting the flow of chips through the bin.

It is the primary object of the present invention to provide a practical system for pre-steaming chips in a chips bin. This and other objects of the invention will become clear from an inspection of the detailed description of the invention, and from the appended claims.

DETAILED DESCRIPTION OF THE INVENTION

Figure 2:
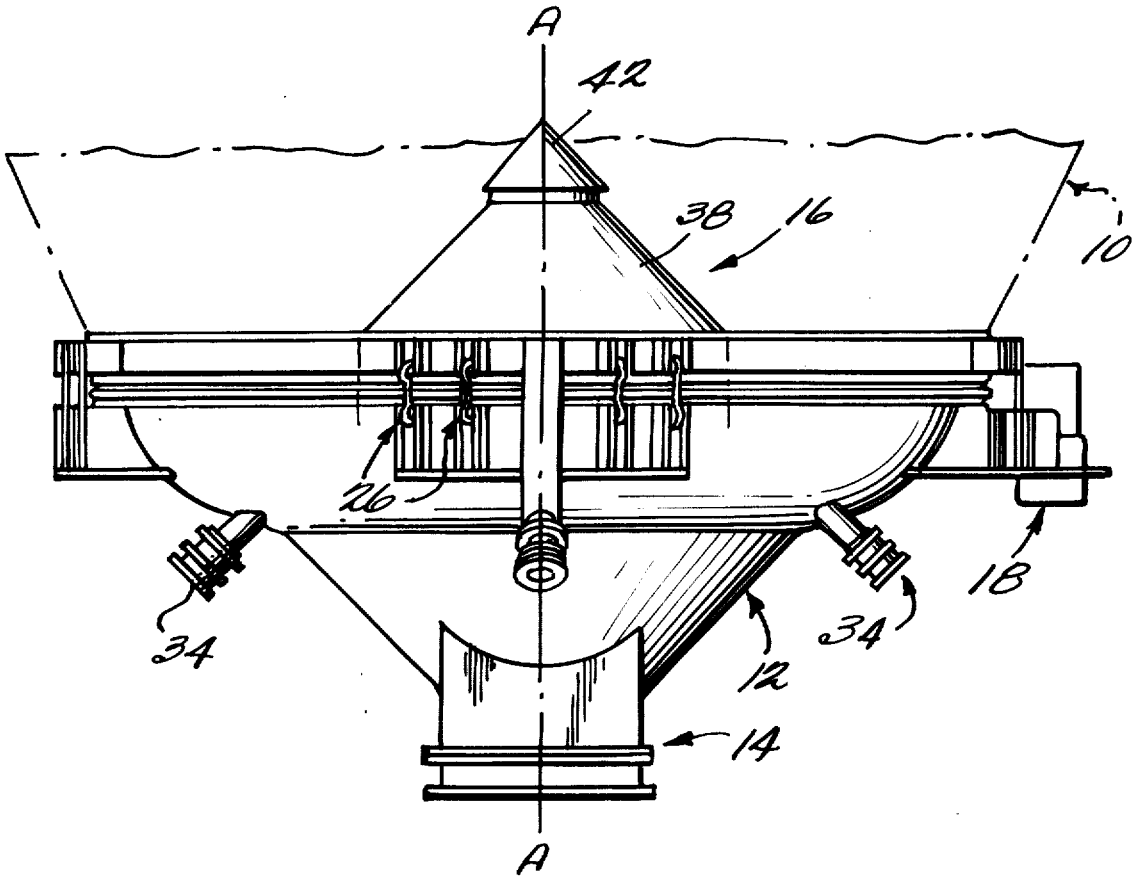
FIG. 2 is a side view of the bin of FIG. 1, showing the top portion of the bin and the means for adding steam in dotted lines.
Figure 3:
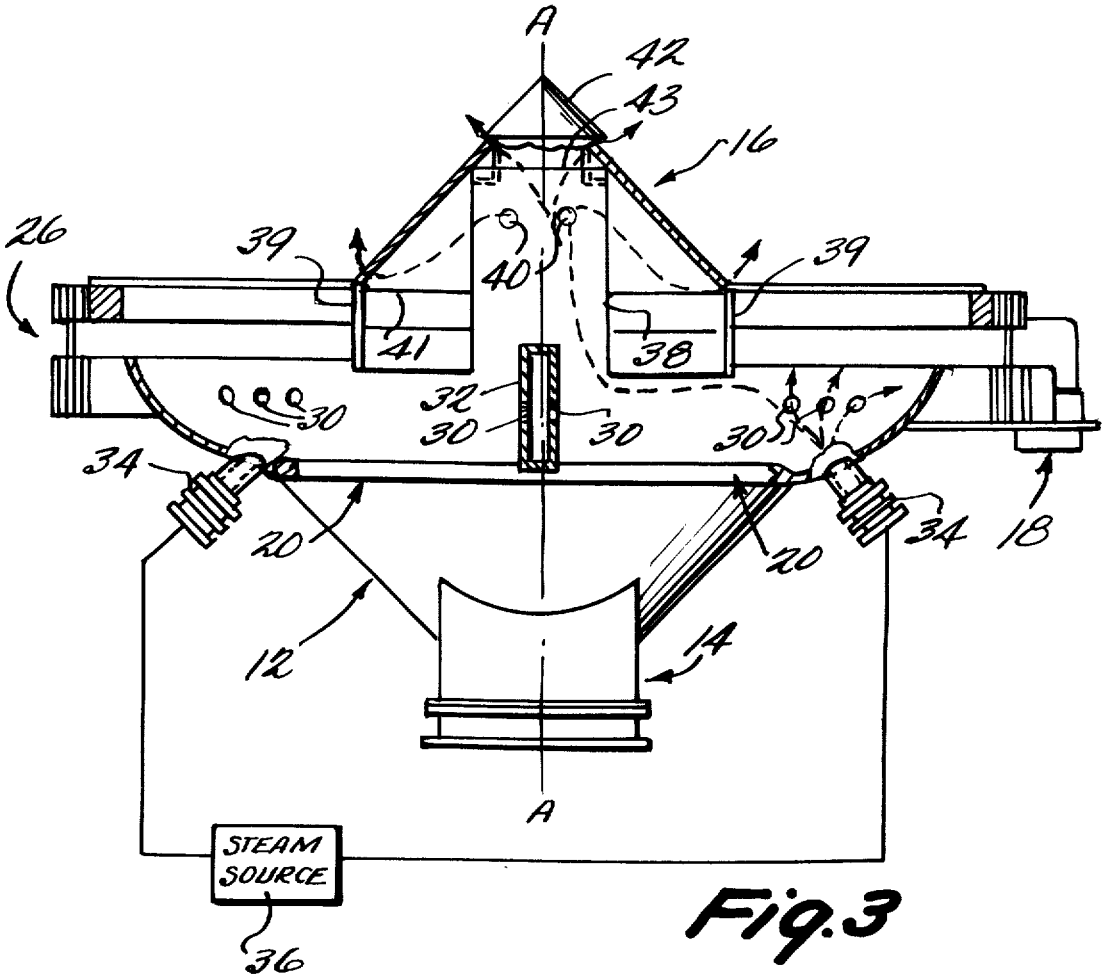
FIG. 3 is a cross-sectional view of the bin of FIG. 2, illustrating the means for adding steam with clarity.
Figure 4:
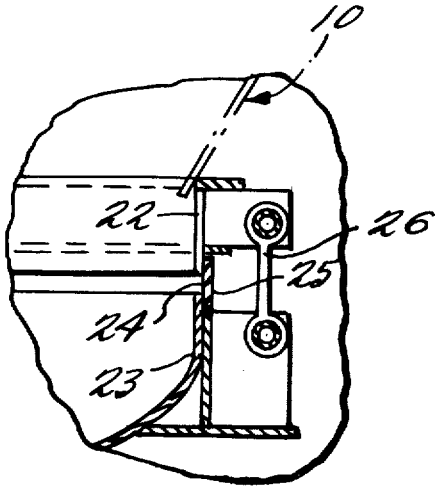
FIG. 4 is a detailed view showing a typical connection of a stationary top portion of the chips bin to the oscillatable bottom portion.

A conventional "Vibra Bin" discharge chips bin includes a generally funnel-shaped stationary top portion, shown in dotted line at 10 in FIGS. 2 and 4, an oscillatable bottom portion 12 with a chips outlet 14 formed of flexible material, an activator cone 16 connected to the bottom portion 12 and disposed above the chips outlet 14, the activator cone 16 and the chips outlet 14 being generally concentric — a vertical straight line A—A (see FIGS. 2 and 3) extending generally between the centers thereof — and power means 18 for oscillating the bottom portion 12 with respect to the top portion 10 in a dimension generally parallel to the straight line A—A. A plurality of arms 20 are provided for connecting the activator cone 16 to the oscillatable bottom portion 12.

Figure 1:
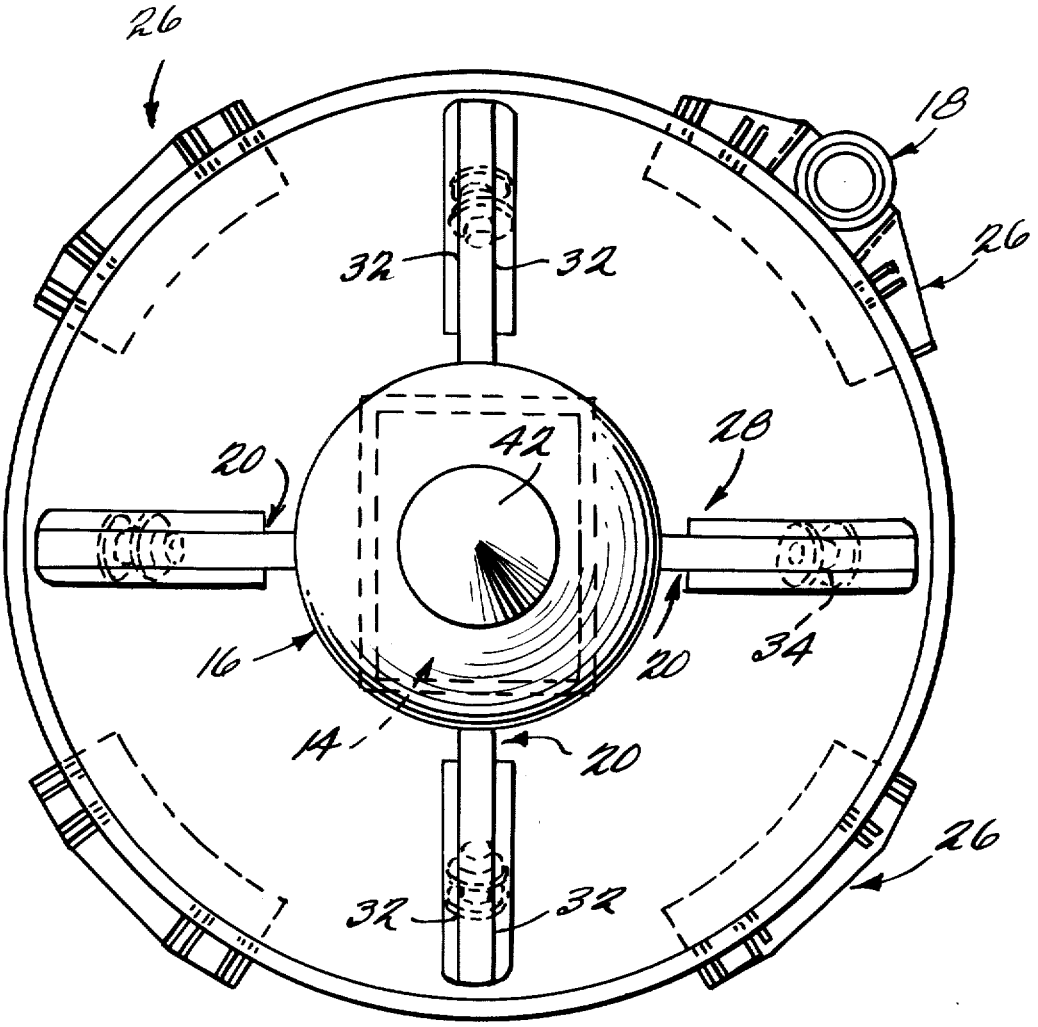
FIG. 1 is a top plan view, with the top portion of the chips bin removed for clarity, of a chips bin according to the present invention.

Both the stationary top portion 10 and the oscillatable bottom portion 12 are generally circular in cross-section. A circular ring base 22 (see FIG. 4 in particular) terminates the top portion 10, and a circular ring-like portion 23 (again see FIG. 4 in particular) provides the upper termination of the bottom portion 12. The rings 22, 23 are connected together by a flexible sleeve 24 with clamps 25 for holding the sleeve 24 in place so that no chips or steam can escape in the gap betwen the rings 22, 23, and a plurality of vibration isolators 26 are provided at points spaced around the circumference of the rings 22, 23 for supporting the top and bottom portions 10, 12 so that oscillatory movement therebetween is possible. The sets of vibration isolators 26 are spaced every 90° around the circumference of the rings 22, 23, with the gyrator beings disposed at one of such locations (see FIG. 1), and such vibrator isolator sets are spaced 45° from the cones supporting arms 20. The flexible material outlet 14 is normally rectangular in cross-section (see FIG. 1) and the outlet 14 normally is connected up to a chips chute, high pressure feeder, or chips meter and pre-steaming vessel.

In chips bin having a "Vibra Bin" discharge, in the past it has been suggested to effect steaming within the interior volume defined by the bin by either adding steam underneath the activator cone, or by adding steam at side locations around the bottom portion 12.

Such techniques have been ineffective for effecting uniform pre-steaming without blockage of the chips flow. According to the improvement of the present invention, means 28 for adding steam to the interior volume defined by the chips bin are provided including a plurality of steam ports 30 (see FIG. 3 in particular) formed in each of the supporting arms 20 of the activator cone 16. Each of the supporting arms 20 has a pair of side faces 32 each disposed in a generally vertical plane (although the sidewalls 32 could taper toward each other), and the arms 20 are hollow. The steam ports 30 are formed in each side face 32 of the supporting arm 20, and preferably about three or four such steam ports are formed in each supporting arm 20, and preferably four arms 20 are provided, spaced 90° around the circumference of the activator cone 16. Each arm 20 preferably is connected up to a separate steam inlet 34 formed of flexible material, and the inlet 34 may be connected to a common exterior source of steam 36. Additionally, the means 28 according to the invention includes means for introducing steam under the activator cone 16. A pipe 38 is in fluid communication with the hollow arms 20, and extends vertically upwardly from the arms 20, concentric with the line A—A (see FIG. 3 in particular). A number of vertically extending support rods 39 may also be provided (see FIG. 3), one associated with each arm 20 for attaching the arm to the base of the cone 16 at spaced points along the circumference of the cone so that the pipe 38 need not carry all of the load for effecting oscillation of the cone 16. The pipe 38 has a number of steam ports 40 formed around the periphery thereof, and steam escaping from the pipe 38 through the ports 40 flows underneath the base 41 of the cone 16. Also, preferably the cone 16 includes a top, pointed portion 42, and the pipe 38 has an open top 43 thereof so that steam flowing through the pipe is introduced into the interior volume underneath the base of the pointed top conical portion 42. The top portion 42 is operatively connected to the bottom portion of the cone 16 and/or the pipe 38 so as not to interfere with the passage of steam underneath the base of the top portion 42.

In using the apparatus according to the present invention, chips are dumped into the generally funnel-shaped stationary top portion 10 of the chips bin, and form a column within the interior volume of the chips bin passing downwardly toward the outlet 14. The gyrator 18 oscillates the bottom portion 12 with respect to the top portion 10 so that passage of the chips through the outlet 14 is facilitated. The steam is introduced from source 36 into the interior volume of the chips bin by the flexible steam inlets 34. The steam passes from each inlet 34 through a respective hollow cone 16 supporting arm 20, and passes outwardly through the steam ports 30 generally perpendicular to a plane containing the center line A—A of the bin — that is generally normal to the direction of flow of the chips through the chips bin. Steam also passes from each arm 20 upwardly into pipe 38, through openings 40, and underneath the base 41 of the cone 16 substantially around the whole circumference of the base 41, and passes through the open top 43 of the pipe 38, and underneath the base of the conical pointed top portion 42 of the cone 16. In an actual operation of the structure illustrated in the present drawings at the Prince Albert continuous cooking installation in Saskatchewan, Canada, despite the fact that the chips that were dumped into the chips bin were frozen and contained ice, it was possible to add sufficient steam to the system to heat the entire frozen mass to above 200° F., without blockage of the chips flow through the outlet 14, and with substantially uniform steaming of the chips.

It will thus be seen that according to the present invention, apparatus has been provided which allows the practical steaming of chips in a vibrating discharge chips bin. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A chips bin including a generally funnel-shaped stationary top portion, an oscillatable bottom portion including a flexible material chips outlet, an activator cone connected to said bottom portion by a plurality of arms extending outwardly from said activator cone, said activator cone disposed above said chips outlet and said activator cone and said chips outlet being generally concentric, a vertical straight line extending generally between the centers thereof, power means for oscillating said bottom portion with respect to said top portion in a dimension generally parallel to said straight line, and means for adding steam to the interior of the volume defined by said top portion and said bottom portion, wherein the improvement comprises said means for adding steam to said interior volume comprising a plurality of steam ports formed in each of said support arms of said activator cone, and means for steaming the chips by supplying steam to said arms for passage through said ports into said volume, and means for introducing steam underneath said activator cone.

2. A chips bin as recited in claim 1 wherein said activator cone includes a cone top, pointed portion, and a cone bottom portion, and wherein said means for introducing steam underneath said activator cone further comprises means for introducing steam underneath both said cone top portion and said cone bottom portion, into the interior of said volume.

3. A chips bin as recited in claim 2 wherein said means for introducing steam underneath said activator cone comprises a pipe in fluid communication with said supporting arms and extending generally concentric with said cone along said straight line and within the interior volume of said cone, said pipe having an open top providing means for introducing steam underneath said cone top portion, and said pipe having a plurality of openings formed along the length thereof having centerlines extending generally perpendicular to said straight line, said openings providing means for introducing steam underneath said cone bottom portion.

4. A chips bin as recited in claim 3 wherein said steam ports formed in each of said supporting arms have centerlines extending generally perpendicular to said straight line.

5. A chips bin as recited in claim 4 wherein said means for adding steam to said interior volume further comprises a flexible steam inlet in communication with the interior of each of said cone supporting arms for introducing steam from an exterior source into the interior of each of said supporting arms.

6. A chips bin as recited in claim 1 wherein said generally funnel-shaped stationary top portion has a generally circular base, and wherein said oscillatable bottom portion has a generally circular top connected to said top portion base by a flexible material sleeve and a plurality of vibration isolators disposed in sets angularly spaced around the circumference of said top portion base and said bottom portion top; and wherein said straight line concentric with said activator cone and said chips outlet is also concentric with said top portion base and said bottom portion top, and wherein said cone supporting arms extend radially outwardly from said cone to said bottom portion.

7. A chips bin as recited in claim 1 wherein four cone supporting arms are provided extending outwardly from said cone, equally spaced around the circumference of said cone.

8. A chips bin as recited in claim 1 wherein said steam ports in each of said respective supporting arms have center lines extending generally perpendicular to a plane containing said straight line and a respective supporting arm.

9. A chips bin as recited in claim 8 wherein each of said supporting arms has a pair of side faces each disposed in a generally vertical plane, and wherein a plurality of said steam ports are formed in each side face of each of said supporting arms.

10. A chips bin including a generally funnel-shaped stationary top portion, an oscillatable bottom portion including a flexible material chips outlet, an activator cone connected to said bottom portion by a plurality of arms extending outwardly from said activator cone, said activator cone disposed above said chips outlet and said activator cone and said chips outlet being generally concentric, a vertical straight line extending generally between the centers thereof, power means for oscillating said bottom portion with respect to said top portion in a dimension generally parallel to said straight line, and means for adding steam to the interior of the volume defined by said top portion and said bottom portion; wherein the improvement comprises, each of said supporting arms having a pair of side faces each disposed in a generally vertical plane, and wherein said means for adding steam to said interior volume comprises a plurality of steam ports formed in each side face of each of said supporting arms, and means for steaming the chips by supplying steam to said arms for passage through said ports into said volume.

* * * * *